United States Patent [19]

Samata

[11] Patent Number: 4,568,319

[45] Date of Patent: Feb. 4, 1986

[54] PAPER FOLDING KNIFE DEVICE OF BELT DRIVE UNIT TYPE FOR PAPER FOLDER

[75] Inventor: Masae Samata, Tokyo, Japan

[73] Assignee: Shoei Machine Manufacturing Co., Ltd., Tokyo, Japan

[21] Appl. No.: 706,063

[22] Filed: Feb. 27, 1985

[51] Int. Cl.[4] ..... F16H 7/00; B65H 45/18

[52] U.S. Cl. ..... 474/148; 493/444

[58] Field of Search ..... 474/148, 101; 493/441–444

[56] References Cited

U.S. PATENT DOCUMENTS 4,175,740 11/1979 Klenk ..... 493/444 X 4,388,073 6/1983 Klenk ..... 493/444

*Primary Examiner*—Stephen J. Novosad

*Assistant Examiner*—Thuy M. Bui

*Attorney, Agent, or Firm*—Flynn, Thiel, Boutell & Tanis

[57] ABSTRACT

A paper folder is disclosed, in which a drive motor and a crank mechanism supplied with power from the motor are not directly coupled together. Instead, they are secured to a common plate such that their respective shafts penetrate the common plate in a suitably spaced-apart relation to one another and coupled together by a belt. An adjusting screw mechanism is assembled in the crank mechanism to permit easy and accurate adjustment of the position of the paper folding knife. The device thus can be constructed as a belt drive unit type device, which produces less noise and is subject to less wear.

1 Claim, 2 Drawing Figures

PAPER FOLDING KNIFE DEVICE OF BELT DRIVE UNIT TYPE FOR PAPER FOLDER

BACKGROUND OF THE INVENTION

Field of the Invention

This invention relates to a paper folding knife device of belt drive unit type for a paper folder.

In the prior art paper folding knife device for a paper folder, the adjustment of the vertical knife position requires not only adjustment of the knife shaft but also adjustment of the vertical position of the entire device body.

Therefore, a drive motor unit which is directly coupled to a head gear is simultaneously vertically moved, and it is impossible to arrange the device body and drive unit such that they are comparatively stationary. For this reason, the prior art paper folder cannt be constructed as an integral unit.

Further, in the prior art paper folding knife device a drive unit to which a motor drive unit is directly coupled, is coupled via a head gear to a shaft, on which a transmission clutch and a brake mechanism for controlling the operation of the transmission crank mechanism is provided to permit a paper folding operation with a vertical crank motion of a paper folding knife. The crank motion of the knife is brought about with the movement of the transmission clutch brake mechanism and drive motor unit directly coupled to the head gear. In the crank motion, the upward motion of the knife shaft is caused with a heavy upward load supplied through the clutch gear, while the downward motion of the knife shaft is a high speed motion in the form of a free fall due to the weight of the knife shaft and without any load. The load on the shaft of the crank mechanism varies with the vertical motion of the knife shaft. Also, when the free fall speed of the downward motion surpasses the crank speed in the downward stroke of the crank from the top dead center to the bottom dead center, a reverse load is produced, with which the drive side is driven from the driven or load side, so that backlash results. This means that there occur impact variations due to tapping of gears, resulting in gear tapping noise for every crank motion cycle. In addition, the gears wear significantly to produce very adverse effects on the motor, clutch, etc. Further, at the time of the crank coupling the load has to be increased in a short period of time. Therefore, a very high surface pressure is applied to the gears. Further, the aforementioned tapping noise and wear of the gears are extremely pronounced as the frequency of installation and removal of the clutch gear is increased with increase of the speed of paper folding operation by the crank mechanism. In this case, damage to the motor, clutch, etc. is readily liable.

Further, the prior art paper folding knife device for a paper folder is considerably large in size and requires a large installation space in addition to the fact that its anti-noise property and life are interior.

To alleviate the above drawbacks it has been contemplated to adopt a variable speed motor to cope with the load variations noted above. In this case, however, the gear mechanism is complicated, and the cost of the motor is high. Further, the mechanism as a whole is large in size, leading to a large size paper folder. From the above ground, the variable speed motor is inadequate and has not yet been employed in practice.

SUMMARY OF THE INVENTION

An object of the invention is to provide a paper folding knife device of belt drive unit type for a paper folder, with which the adjustment of the knife position can be done very conveniently without need of any vertical operation of the knife device as a whole inclusive of a drive mechanism but by merely operating an adjeusting screw mechanism.

Another object of the inention is to provide a paper folding knife device of belt drive unit type for a paper folder, which can be constructed as a small unit as a whole.

A still further object of the invention is to provide a paper folding knife device of belt drive unit type for a paper folder, which can solve the problems of load acceleration, noise and wear and is excellent in durability and economy.

According to the invention there is provided a paper folding knife device of belt drive unit type for a paper folder vertically moved by a transmission crank mechanism driven by a drive motor, in which the drive motor and a brake mechanism of the paper folding knife device are secured to a common plate with a shaft supporting a pulley of the drive motor and a shaft supporting a pulley of the brake mechanism penetrating the plate and coupled together by a transmission belt passed round the pulleys noted above, and a suitable adjusting screw mechanism is provided with respect to the brake mechanism. Thus, the adjustment of the knife can be done very conveniently. In addition, the device can be constructed as a small size unit. Further, the device is less subject to wear and has long life.

DETAILED DESCRIPTION OF THE PREFERRED EMBODIMENT

Figure 1:
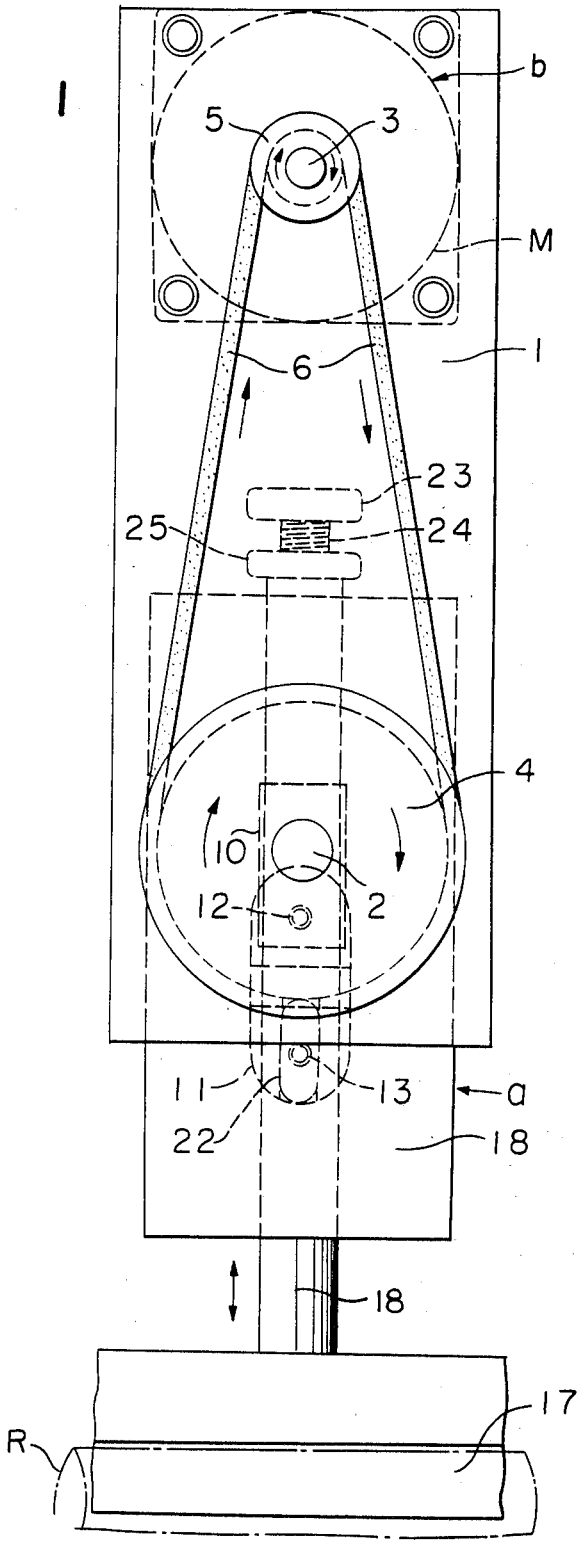
FIG. 1 is a front view showing a paper folding knife device of belt drive unit type for a paper folder employing the invention with part of a knife section omitted.
Figure 2:
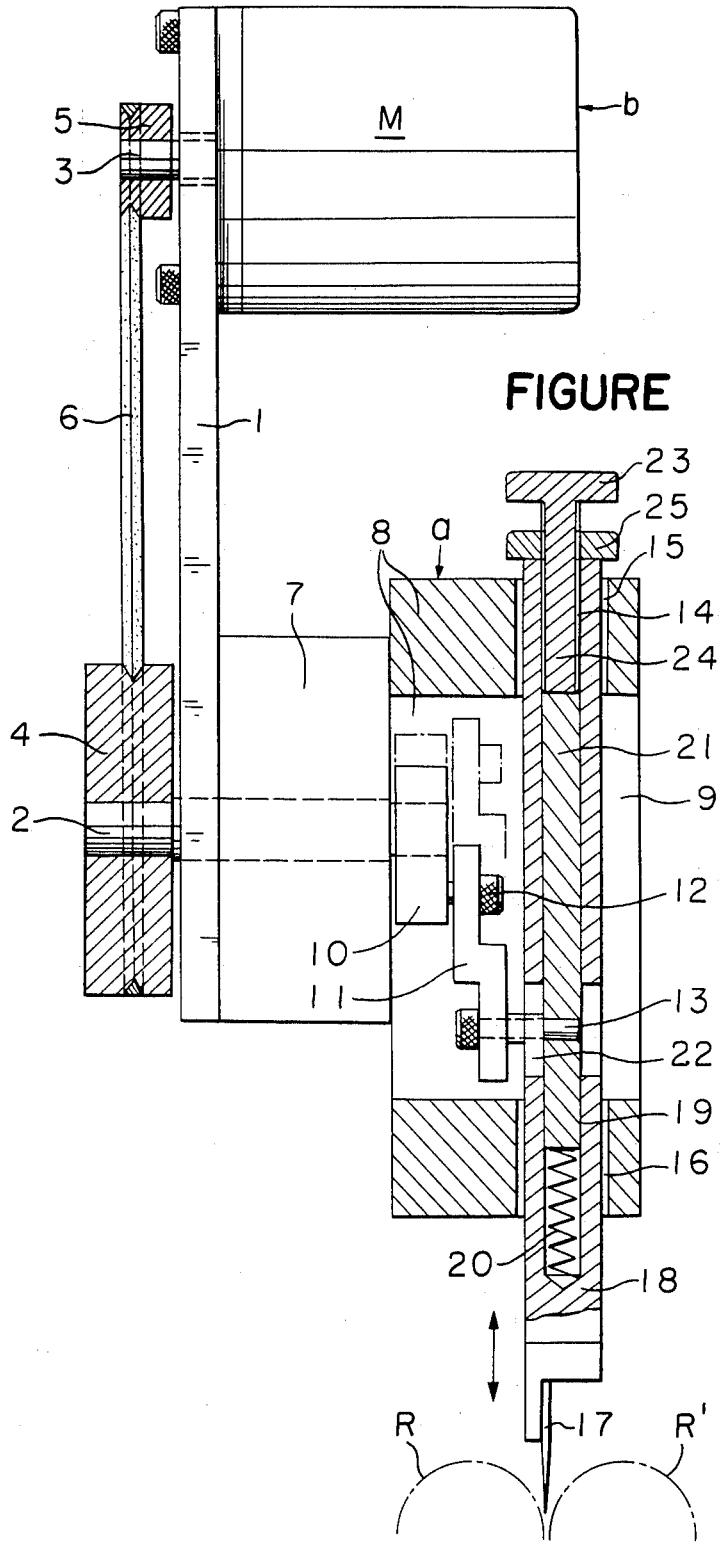
FIG. 2 is a sectional view showing a main part of the same device taken from the right side of FIG. 1.

An embodiment of the invention will now be described with reference to the accompanying drawings. Referring to the Figures, reference numeral 1 designates a rectangular plate. A paper folding knife body a for a peper folder, which is capable of adjustment of the vertical knife position with a suitable adjusting screw mechanism, and a paper folding knife mechanism of which is vertically movable by a transmission crank mechanism, is secured to a lower portion of the plate 1. A drive motor unit b for driving the body a is secured to an upper portion of the plate 1. A shaft 2 of the knife body a and a shaft 3 of the motor unit b respectively have pulleys 4 and 5 secured to them. These pulleys 4 and 5 face each other outside the plate 1.

A transmission belt 6 made of rubber or a resin material, is passed round the pulleys 4 and 5 facing each other, so that the body a is indirectly driven through the belt.

The above structure of the paper folding knife device body a of the paper folder concerns a general crank mechanism, which includes a clutch brake mechanism 7 which is well known in the art. The mechanism 7 has a housing 8, into which the shaft 2 extends. The housing has a window 9 provided for inspecting its interior and also for making repairs, and it accommodates a crank mechanism. The shaft 2 has an excentric disk 10 secured to it. A crank rod 11 has one end portion provided by a screw 12 to the excentric disk 10, and it has a crank pin 13 provided at the other end.

A paper folding knife 17 is mounted on the lower end of a hollow knife shaft 18, which penetrates aligned upper and lower see-through holes 15 and 16 formed in the housing 18 and has a predetermined length.

The hollow knife shaft 18, has a bore 19 which blind at the bottom and has a female thread 14 formed in an upper end portion. An elastic member 20 such as a coil spring is fitted in a bottom portion of the bore 19, and a core member 21 is loosely fitted in the bore 19 above the coil spring. The core member 21 is slidable along the bore 19 and has a length reaching the female thread portion of the knife shaft 18.

The knife shaft 18 is formed with an axial slot 22 in a portion corresponding to a lower portion of the core member 21. A crank pin 13 is inserted through the slot 22 and screwed in the core member 21. An adjusting screw 24 is screwed in the female thread formed in the upper portion of the knife shaft 18 penetrating the see-through holes 15 and 16 formed in the housing 18. The adjusting screw 24 is screwed until it is in contact with the core member 21, and in this state its upper portion projects from the knife shaft 18. It has a knob 23 provided at the top. A nut 25 is screwed on the exposed threaded portion of the adjusting screw 24 such that it engages the upper end of the knife shaft 18.

The construction of the body a is not limited to the illustrated one, but it is possible to make various design changes of the knife shaft mechanism and adjusting screw mechanism.

In the illustrated arrangement, the body a and motor unit b arranged vertically with respect to the plate 1, but the arrangement is horizontal if the plate is disposed horizontally. Reference symbols R and R′ in the Figures designate paper folding rollers. The crank mechanism and the knife shaft mechanism which undergoes crank motion can be suitably modified in design.

With the construction according to the invention, when the pulley 5 is rotated with the rotation of the motor the pulley 4, and hence the shaft 2, of the body a is rotated by the belt 6, and with the rotation of the excentric disk 10 the crank rod 11 undergoes a crank motion. With the the vertical motion of the crank pin 13 the knife shaft 17 is moved in vertical directions between the paper folding rollers R and R′, whereby the operation of folding paper by the knife is effected.

According to the invention, the body a and drive motor unit b are disposed in a spaced-apart relation to each other on the single plate 1, and the crank motion of the body a is indirectly caused via the transmission belt 6. Therefore, even if the free falling speed of the crank rod surpasses the crank speed so that there occurs such a load speed that the drive side is driven by the load side, that is, even if there occurs a situation that the rotational speed of the load side pulley 4 momentarily surpasses that of the drive side pulley 5 in the downward crank action, the belt 6 slips with respect to the high speed rotation of the load side due to its flexibility and thus absorbs the load speed. Consequently, the load side along runs more than the drive side without resistance. In other words, in the crank motion which is based on the transmission belt, irrespective of whether speed ratio with which the load side speed surpasses the drive side speed and also irrespective of how high the crank frequency is, the belt adops itself to the load speed and the load side executes slip rotation with respect to the belt. Therefore, unlike the case of the gear coupling there occurs neither shock variations nor noise. It is thus possible to ensure stable performance for long time as well as eliminating noise.

The adjustment of the vertical position of the knife according to the crank motion, is done as follows. The vertical crank motion of the crank pin 13 is performed in the slot 22 formed in the knife shaft 18. Thus, the core member 21, which is loosely fitted in the bore 19 of the knife shaft 18 and coupled to the pin 13, executes vertical sliding motion in the bore 19 owing to the elasticity of the elastic member 20.

In the upward stroke of this vertical motion, the core member 21 pushes up the upper adjusting screw 24 in contact with it, that is, it pushes up, in unison with the screw 24, the knife shaft 18, in which the screw 24 is screwed, so that the paper folding knife 17 is raised. In the downward stroke, on the other hand, the lower end surface of the core member 21 pushes down the elastic member 20, and the knife shaft 18 is also lowered with a build-up of spring pressure. In this way, the knife shaft 18 undergoes a vertical crank motion, whereby a paper folding operation with the knife takes place.

To adjust the knife position, the nut 25 is loosened, and the adjusting screw 24 is turned by turning the knob 23. With the rotation of the screw 24 the knife shaft 18, in the female thread of which the screw 24 is screwed, is vertically displaced with respect to the core member 21 with an elongation or contraction of the elastic member 20. The vertical position of the knife thus can be adjusted easily, quickly and accurately. After the knife position is adjusted, the adjusting screw 24 is locked by clamping the nut 25.

It is to be appreciated that fine adjustment of the sole knife shaft 18 can be done directly, easily, quickly and accurately without need of moving the body a and irrespective of the vertical crank motion of the knife but by simply turning the adjustng screw.

The arrangement of the body a and drive motor unit b in a spaced-apart relation to each other on the single plate 1, which is a feature of the invention, is particularly effective in that this mechanism is capable of adjustment of the knife shaft 18 while the body a is stationary, while it permits a design of coupling together the body a and drive mechanism with a belt.

It is thus possible to realize size reduction of the knife device as a whole so as to reduce the installation space required. It is thus possible to provide a transmission crank type paper folding knife device as a small size unit, which is totally free from noise from the drive mechanism, has long life and has very excellent stable performance. Further, the belt drive mechanism permits use of a belt drive mechanism, which is very advantageous in economy and practicity as well as leading to high demand.

What is claimed is:

1. A paper folding knife device of belt drive unit type for a paper folding comprising a drive motor, a brake unit and an adjusting screw mechanism, a shaft of said drive motor and a shaft of said brake unit penetrating respective holes formed in a common plate and having respective pulleys facing each other and coupled together by a belt passed thereround, said adjusting screw mechanism including a housing, a tubular member connected to said brake unit and vertically pentrating said housing, a core member loosely fitted in said tubular member, an adjusting screw screwed in said tubular member and in contact with one end of said core member, an elastic member fitted in said tubular member and in contact with the other end of said core member, a paper folding knife of said paper folder being secured to said tubular member, one end of the shaft of said brake unit being coupled to said core member via an eccentric disk, a crank rod and a pin.

* * * * *